US010636367B2

(12) United States Patent
Liao et al.

(10) Patent No.: US 10,636,367 B2
(45) Date of Patent: Apr. 28, 2020

(54) DISPLAY AND COLOR CORRECTION METHOD

(71) Applicant: Qisda Corporation, Taoyuan (TW)

(72) Inventors: Chun-Hsiang Liao, Taoyuan (TW); Cheng-Lung Wu, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 17 days.

(21) Appl. No.: 16/169,128

(22) Filed: Oct. 24, 2018

(65) Prior Publication Data

US 2019/0130852 A1 May 2, 2019

(30) Foreign Application Priority Data

Oct. 27, 2017 (CN) ..... 2017 1 1025054

(51) Int. Cl.
*G09G 3/34* (2006.01)

(52) U.S. Cl.
CPC ... *G09G 3/3413* (2013.01); *G09G 2320/0242* (2013.01); *G09G 2320/0626* (2013.01); *G09G 2320/0646* (2013.01); *G09G 2320/0666* (2013.01); *G09G 2360/144* (2013.01)

(58) Field of Classification Search
CPC ..... G09G 3/3413; G09G 2320/0666; G09G 2360/144
See application file for complete search history.

(56) References Cited

U.S. PATENT DOCUMENTS

2007/0091055 A1* 4/2007 Sakuda ..... G09G 3/3413 345/102
2007/0171217 A1* 7/2007 Tsai ..... G09G 3/3406 345/207
2008/0129678 A1* 6/2008 Choi ..... G09G 3/3413 345/102
2008/0303918 A1* 12/2008 Keithley ..... G09G 3/20 348/223.1
2011/0096084 A1* 4/2011 Hu ..... G09G 3/3413 345/589
2013/0278643 A1* 10/2013 Otsuka ..... G09G 5/02 345/690
2017/0202070 A1* 7/2017 Dong ..... G09G 3/3413

FOREIGN PATENT DOCUMENTS

CN 103295560 B 1/2016

* cited by examiner

*Primary Examiner* — Sepehr Azari

(57) ABSTRACT

A display and a color correction method are disclosed. The display includes a panel, a backlight module, a first sensing unit, a second sensing unit and a processing module. The first sensing unit senses a real-time ambient light information of an environment that the display is located in. The processing module estimates a target display lightness according to the real-time ambient light information and adjusts a backlight intensity to an adjusted backlight intensity to make a backlight intensity of the panel substantially the same with the target display lightness. The second sensing unit senses an adjusted backlight information of the backlight module. The processing module estimates a color gain compensation value for the panel according to the adjusted backlight information and the real-time ambient light information and compensates the colors displayed on the panel when the panel displays an image according to the color gain compensation value.

20 Claims, 7 Drawing Sheets

DISPLAY AND COLOR CORRECTION METHOD

BACKGROUND OF THE INVENTION

1. Field of the Invention

The invention relates to color correction; in particular, to a display and a color correction method applied to the display.

2. Description of the Prior Art

The current display device can automatically adjust the backlight intensity of the backlight module in accordance with a sensed ambient light, so that the user's eyes may not feel too tired because of the inconsistency brightness between the displayed image and the ambient light. In addition, the display can be cooperated with the chrominance detection of the ambient light, so that the color temperature of the panel can be consistent with the ambient light, and it can make a person feel more comfortable when he watches the display.

However, in the process of adjusting the backlight intensity of the display in accordance with the color performance of the ambient light, the backlight emitted by the backlight module is often affected by aged factors such as driving current or long-term use causing degradation. Brightness and chrominance of the panel may be also changed and deviated from the original color performance consistent with the ambient light. When a person watches the aged display, he may feel that the color performance of the display is deteriorated.

SUMMARY OF THE INVENTION

Therefore, the invention provides a display and a color correction method applied to the display to overcome the above-mentioned problems in the prior art.

An embodiment of the invention is a color correction method. In this embodiment, the color correction method is applied to a display. The display includes a panel and a backlight module. The color correction method includes steps of: (a) sensing a real-time ambient light information of an environment that the display is located in; (b) estimating a target display brightness according to the real-time ambient light information; (c) adjusting a backlight intensity of the backlight module to an adjusted backlight intensity to make a display brightness of the panel substantially the same as the target display brightness; (d) sensing an adjusted backlight information of the backlight module and estimating a color gain compensation value for the panel according to the adjusted backlight information and the real-time ambient light information; and (e) compensating the colors displayed on the panel when the panel displays an image according to the color gain compensation value.

In this embodiment, the step (c) further includes: adjusting the backlight intensity of the backlight module according to a panel brightness characteristic information and the target display brightness.

In an embodiment, the panel brightness characteristic information is generated by steps of: (f1) when the backlight module emits a first backlight to the panel, sensing a first brightness information of the panel in front of the panel; (f2) when the backlight module emits a second backlight to the panel, sensing a second brightness information of the panel in front of the panel, wherein the second backlight is different from the first backlight; and (f3) estimating the panel brightness characteristic information according to the first backlight, the first brightness information, the second backlight and the second brightness information.

In an embodiment, the step (f3) further includes: estimating the panel brightness characteristic information according to interpolation method.

In an embodiment, the step (d) further includes: (d1) estimating a restored color gain compensation value according to the adjusted backlight information and a target color information; and (d2) estimating the color gain compensation value according to the real-time ambient light information and the restored color gain compensation value.

In an embodiment, the target color information is target color values of the backlight module corresponding to different backlights, and the restored color gain compensation value is estimated according to a difference between the adjusted backlight information and the target color information.

In an embodiment, the step (d1) further includes: when the backlight module emits a first backlight to the panel, sensing a first color information of the panel in front of the panel; when the backlight module emits a second backlight to the panel, sensing a second color information of the panel in front of the panel, wherein the second backlight is different from the first backlight; and estimating the target color information according to the first backlight, the first color information, the second backlight and the second color information.

In an embodiment, the step (d2) further includes: setting a plurality of color temperature sections; determining that the real-time ambient light information belongs to a first color temperature section of the plurality of color temperature sections; and determining the color gain compensation value according to the first color temperature section and the restored color gain compensation value.

In an embodiment, the real-time ambient light information includes a real-time ambient light brightness, a real-time ambient light chrominance and a real-time ambient light color temperature.

Another embodiment of the invention is a display. In this embodiment, the display includes a panel, a backlight module, a first sensing unit, a second sensing unit and a processing module. The backlight module is configured to emit a backlight to the panel. The first sensing unit is configured to sense a real-time ambient light information of an environment that the display is located in. The second sensing unit is disposed at a side of the backlight module. The processing module is coupled to the panel, the backlight module, the first sensing unit and the second sensing unit respectively. The processing module estimates a target display brightness according to the real-time ambient light information and adjusts a backlight intensity of the backlight module to an adjusted backlight intensity to make a display brightness of the panel substantially the same as the target display brightness, and the second sensing unit senses an adjusted backlight information of the backlight module, and the processing module estimates a color gain compensation value for the panel according to the adjusted backlight information and the real-time ambient light information and compensates the colors displayed on the panel when the panel displays an image according to the color gain compensation value.

Another embodiment of the invention is a color correction method. In this embodiment, the color correction method is applied to a display. The display includes a panel and a backlight module. The color correction method includes steps of: (a) sensing a real-time ambient light information of an environment that the display is located in; (b) estimating a target display brightness according to the real-time ambient light information; (c) adjusting a backlight intensity of the backlight module to an adjusted backlight intensity to make a display brightness of the panel substantially the same as the target display brightness; (d) sensing an adjusted backlight information of the backlight module and estimating a color gain compensation value for the panel according to the adjusted backlight information and a target color information; and (e) compensating the colors displayed on the panel when the panel displays an image according to the color gain compensation value.

Compared to the prior arts, the display and the color correction method of the present invention firstly sense the chrominance and brightness change information of the ambient light through the ambient light sensor to estimate the target display brightness that the panel should have. Adjusting the backlight intensity of the backlight module to make the brightness of the panel is substantially the same as the target display brightness. Sensing the adjusted backlight intensity through the backlight sensor to estimate the color gain compensation value for the panel and compensate the colors displayed on the panel when the panel displays an image according to the color gain compensation value.

By doing so, even if the backlight emitted by the backlight module changes and the brightness and chrominance of the panel deviate from the color performance consistent with the ambient light, the present invention can adjust the backlight intensity of the backlight module according to the real-time sensed ambient light information and then compensate the colors displayed on the panel according to the adjusted backlight intensity and the panel characteristic information, thereby the color attenuation of the backlight module can be effectively compensated, and the brightness and chrominance of the panel can maintain the color performance consistent with the ambient light, so that the human eye can have a more comfortable feeling when viewing the display.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

A preferred embodiment of the invention is a display. In this embodiment, the display has color correction function to maintain the brightness and chrominance of the image displayed by the display consistent with the ambient light, so that the human eye can have a more comfortable feeling when using the display.

Figure 1:
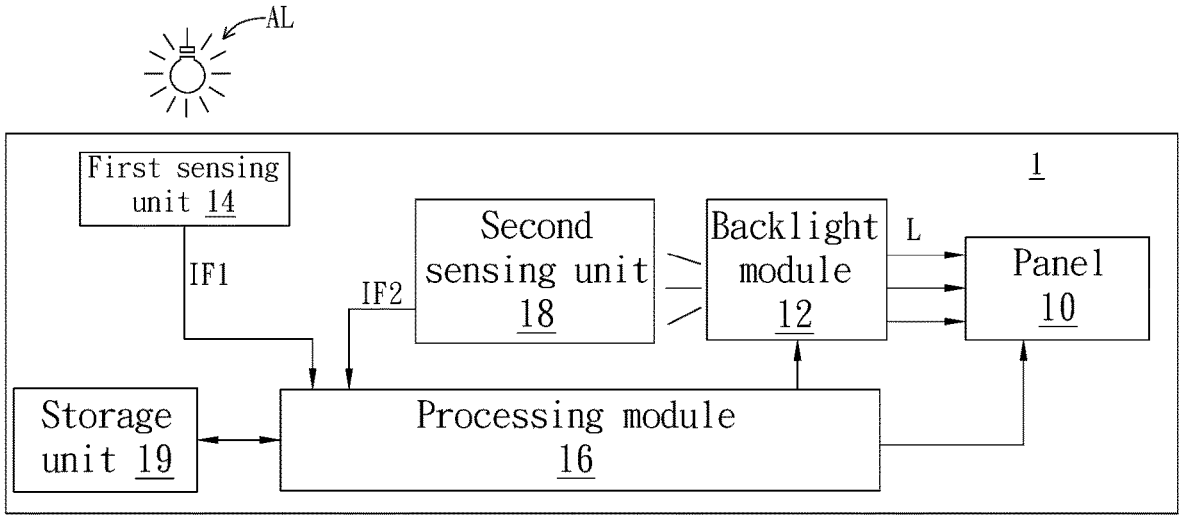
FIG. 1 illustrates a functional block diagram of the display in an embodiment of the invention.

Please refer to FIG. 1. FIG. 1 illustrates a functional block diagram of the display in this embodiment. As shown in FIG. 1, the display 1 includes a panel 10, a backlight module 12, a first sensing unit 14, a processing module 16, a second sensing unit 18 and a storage unit 19. The processing module 16 is coupled to the panel 10, the backlight module 12, the first sensing unit 14, the second sensing unit 18 and the storage unit 19 respectively. The second sensing unit 18 is disposed at a side of the backlight module 12 and used for sensing the intensity value and the chrominance value of the lights emitted by the backlight module 12.

In practical applications, the panel 10 can be any panel capable of displaying image, such as a liquid crystal display (LCD) panel, but not limited to this; the processing module 16 can be any processor capable of processing data, such as the microcontroller, but not limited to this; the storage unit 19 can be any memory capable of storing data, such as the random access memory (RAM) or the read-only memory (ROM), but not limited to this; the first sensing unit 14 can be any light sensor having the ambient light sensing function and it can be disposed on the surface of the casing (not shown in the figures) of the display 1, and it is preferably disposed above the surface of the casing of the display 1; the second sensing unit 18 can be any light sensor capable of sensing the brightness and the chrominance of the backlight.

In this embodiment, the backlight module 12 is used to emit a backlight L to the panel 10. The first sensing unit 14 is used to sense a real-time ambient light information IF1 of the ambient light AL in an environment that the display 1 is located in and then transmit the real-time ambient light information IF1 to the processing module 16. In practical applications, the real-time ambient light information IF1 sensed by the first sensing unit 14 can include the information such as a real-time ambient light brightness, a real-time ambient light chrominance and a real-time ambient light color temperature of the ambient light AL in an environment that the display 1 is located in, but not limited to this.

When the processing module 16 receives the real-time ambient light information IF1, the processing module 16 can estimate the target display brightness that should be present on the display surface of the panel 10 according to the real-time ambient light brightness in the real-time ambient light information IF1. In a practical application, the storage unit 19 can store a look-up table, and the look-up table can include the correspondence between the target display brightness of the panel 10 and the ambient light brightness, so that the processing module 16 can find out the target display brightness corresponding to the real-time ambient light brightness from the look-up table stored in the storage unit 19. In addition, the processing module 16 can also store the real-time ambient light information IF1 in the storage unit 19 for subsequent use.

Then, the processing module 16 will determine whether the display brightness of the panel 10 is substantially the same as the target display brightness according to the look-up table and the light intensity currently emitted by the backlight module 12. When the display brightness of the panel 10 is not substantially the same as the target display brightness, the processing module 16 starts to adjust the backlight intensity of the backlight module 12 until the display brightness of the panel 10 is substantially the same as the target display brightness. It should be noted that the processing module 16 can adjust the backlight intensity of the backlight module 12 according to the target display brightness and a panel brightness characteristic information, but not limited thereto. The panel brightness characteristic information corresponds to the penetration characteristic of the panel, that is, when the light emitted by the backlight source with the same light intensity penetrates different panels, the brightness measured on the other side of the different panels will be different mainly due to the material or process difference.

For example, when the processing module 16 adjusts the backlight intensity of the backlight module 12 to an adjusted backlight intensity, the second sensing unit 18 will sense an adjusted backlight information IF2 of the backlight module 12. The adjusted backlight information IF2 includes the adjusted backlight brightness and the adjusted backlight intensity of the backlight module 12, but is not limited thereto. Then, the processing module 16 estimates the corresponding adjusted display brightness of the panel 10 according to the adjusted backlight brightness of the adjusted backlight information IF2 and determine whether the adjusted display brightness is substantially the same as the target display brightness.

When the brightness of the panel 10 is not substantially the same as the target display brightness, it means that the correction of the backlight intensity is not completed, the processing module 16 will continue to adjust the backlight intensity of the backlight module 12; when the processing module 16 determines that the adjusted display brightness of the panel 10, according to the backlight information IF2, is substantially the same as the target display brightness, it means that the correction of the backlight intensity of the backlight module 12 is completed, the processing module 16 will stop adjusting the backlight intensity of the backlight module 12.

Next, the display device 1 also needs to determine whether to compensate the color of the panel 10 or not. For example, the processing module 16 can determine whether the real-time ambient light color temperature in the real-time ambient light information IF1 is substantially the same as the display color temperature of the panel 10.

When the real-time ambient light color temperature in the real-time ambient light information IF1 is substantially the same as the display color temperature of the panel 10, it means that the colors displayed on the panel 10 does not need to be compensated. When the real-time ambient light color temperature in the real-time ambient light information IF1 is not substantially the same as the display color temperature of the panel 10 (the color temperature is the same in the same color temperature section), it means that the color of the panel 10 needs to be compensated. At this time, the processing module 16 will estimate a color gain compensation value for the panel 10 according to the adjusted backlight intensity of the adjusted backlight information IF2 and the real-time ambient light color temperature of the real-time ambient light information IF1. And, the processing module 16 will perform color compensation on the image signal inputted to the panel 10 according to the color gain compensation value and then transmit the compensated image signal to the panel 10 to display the compensated image.

In practical applications, the processing module 16 can store the real-time ambient light information IF1, the adjusted backlight information IF2, and the color gain compensation value in the storage unit 19, but not limited thereto. The processing module 16 can estimate a restored color gain compensation value according to a difference between the adjusted backlight information IF2 and a target color information (e.g., the target color values corresponding to different backlights of the backlight module 12) to compensate the attenuation of the backlight color. Then estimating a color gain compensation value according to the restored color gain compensation value and the real-time ambient light color temperature of the real-time ambient light information IF1 to adjust the colors displayed on the panel 10 to adapt to the environment that the display 1 is located in. The processing module 16 may directly estimate the color gain compensation value for the panel 10 according to the adjusted backlight intensity of the adjusted backlight information IF2 and the target color information, and there is no particular limitation.

It should be noted that, when the display 1 is in a factory before sale, the display 1 can be process in a calibration process. The backlight module 12 emits different backlights with different backlight values to the panel 10, a plurality of color information can be correspondingly measured in front of the panel 10 and the processing module 16 can estimate the target color information according to the different backlight values and the plurality of color values, which will be further described in the following paragraphs.

In addition, the processing module 16 can store a plurality of preset color temperature sections and determine whether the real-time ambient light color temperature of the real-time ambient light information IF1 belongs to any of the color temperature sections of the plurality of color temperature sections. For example, it is assumed that the processing module 16 sets three color temperature sections including a first color temperature section (<4000K), a second color temperature section (4000K~5500K) and a third color temperature section (>5500K) arranged in the order of low color temperature to high color temperature. If the processing module 16 determines that the real-time ambient light color temperature of the real-time ambient light information IF1 is 3800K, that is, the real-time ambient light color temperature of the real-time ambient light information IF1 belongs to the first color temperature section of the above-mentioned three color temperature sections, then the processing module 16 can determine the color gain compensation value according to the restored color gain compensation value and the first color temperature section. The rest of the situation can be deduced by analogy, and will not be described here. Of course, the processing module 16 can also set or store more color temperature sections, such as nine color temperature sections, to more accurately determine the color gain compensation value, but not limited thereto.

Figure 2:
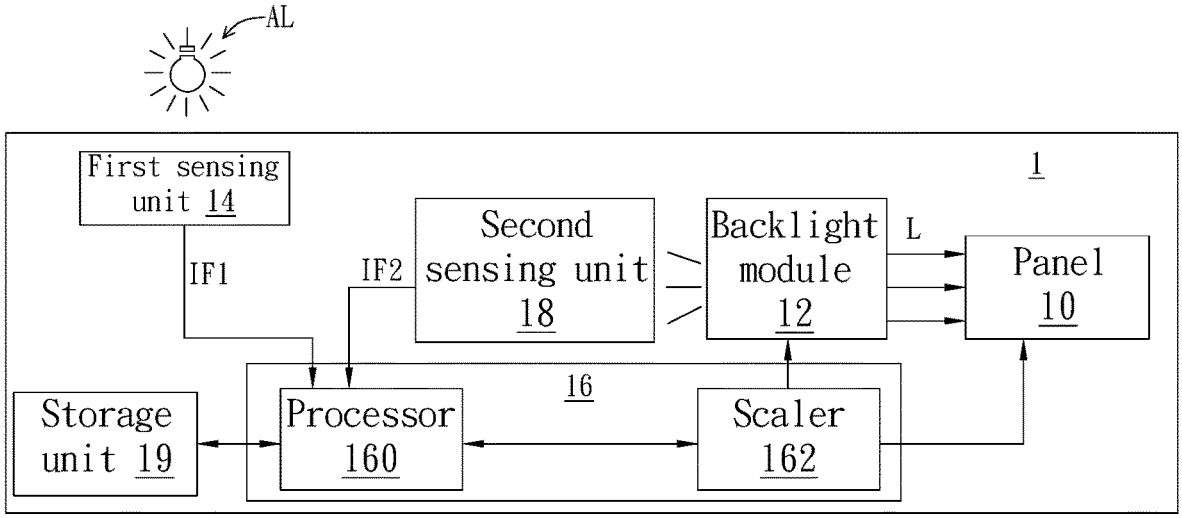
FIG. 2 illustrates a functional block diagram of the display in another embodiment of the invention.

In a practical application, as shown in FIG. 2, the processing module 16 can further include a processor 160 and a scaler 162. The processor 160 is coupled to the first sensing unit 14, the second sensing unit 18 and the storage unit 19 and used for respectively receiving the real-time ambient light information IF1 sensed by the first sensing unit 14 and the adjusted backlight information IF2 sensed by the second sensing unit 18 and the real-time ambient light information IF1 and the adjusted backlight information IF2 can be stored in the storage unit 19; the scaler 162 is coupled to the panel 10, the backlight module 12 and the processor 160 respectively and used for adjusting the resolution of the image signal according to the native resolution of the panel 10 and controlling the operation of the panel 10 and the backlight module 12. In fact, the processor 160 and the scaler 162 can be integrated or disposed independently without any particular limitation.

Figure 3:
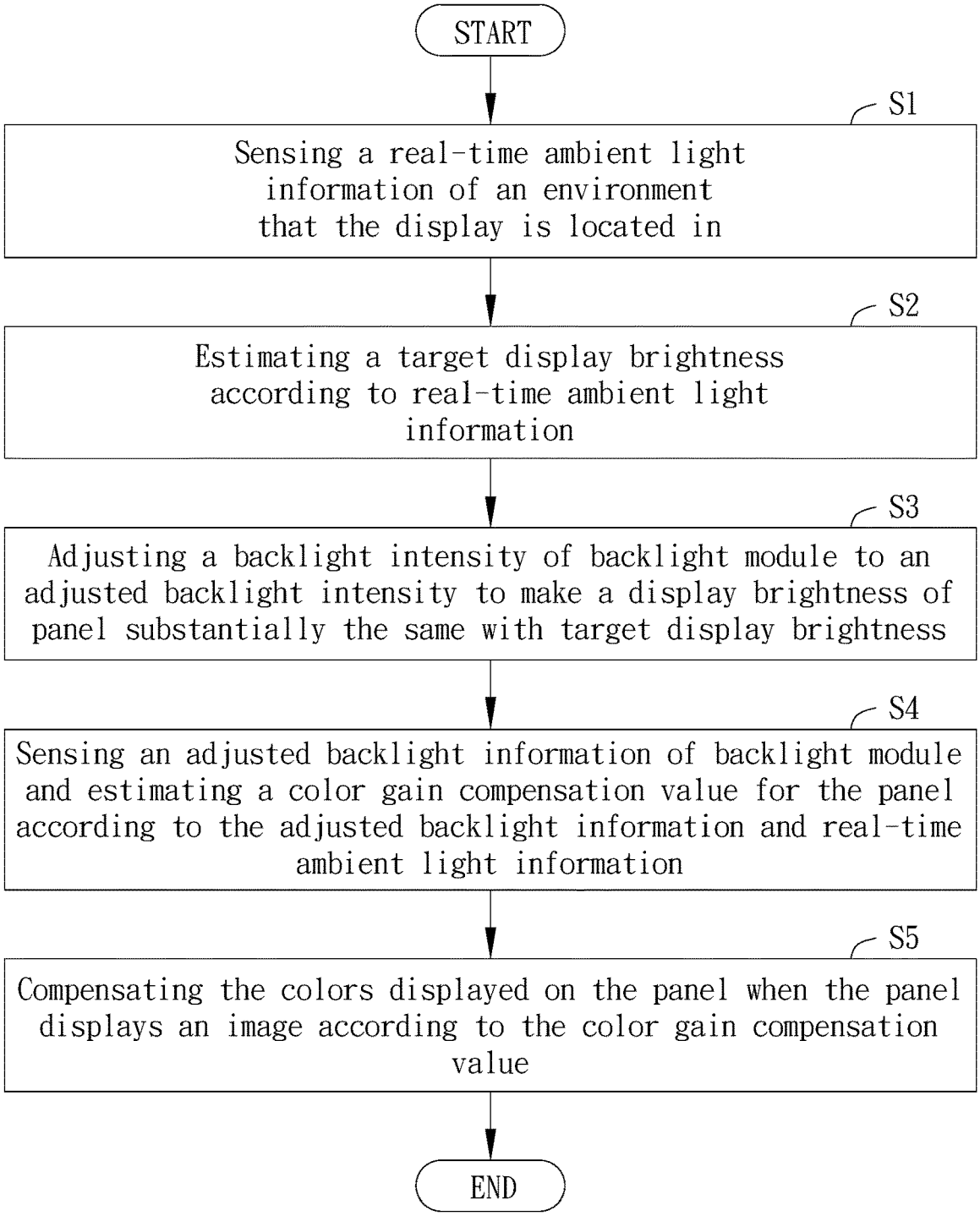
FIG. 3 illustrates a flowchart of the color correction method in another embodiment of the invention.

Another preferred embodiment of the invention is a color correction method. In this embodiment, the color correction method is applied to a display. The display includes a panel and a backlight module. Please refer to FIG. 3. FIG. 3 illustrates a flowchart of the color correction method in this embodiment. As shown in FIG. 3, the color correction method can include following steps of:

S1: sensing a real-time ambient light information of an environment that the display is located in;

S2: estimating a target display brightness according to the real-time ambient light information;

S3: adjusting a backlight intensity of the backlight module to an adjusted backlight intensity to make a display brightness of the panel substantially the same as the target display brightness;

S4: sensing an adjusted backlight information of the backlight module and estimating a color gain compensation value for the panel according to the adjusted backlight information and the real-time ambient light information;

S5: compensating the colors displayed on the panel when the panel displays an image according to the color gain compensation value.

It should be noted that the real-time ambient light information in the step S1 can actually include the information such as real-time ambient light brightness, real-time ambient light color and instant ambient light color temperature, but is not limited thereto; the step S3 can adjust the backlight intensity of the backlight module according to the panel brightness characteristic information and the target display brightness, but not limited thereto; the step S4 can estimate the restored color gain compensation value according to the difference between the adjusted backlight information (such as the adjusted backlight intensity) and the target color information, or estimate the restored color gain compensation value according to the target color value estimated in a calibration process when the display is in a factory before sale. For example, when the display is in the factory before sale, the backlight module is not attenuated. A white light generated by the backlight module, the value of red color measured by a colorimeter is r1. The value of green color measured by the colorimeter is g1. The value of blue color measured by the colorimeter is b1. After being used for a period of time, because the backlight module is aged, when the white light of the backlight module is measured again, the value of red color measured by the colorimeter becomes r2, the value of green color measured by the colorimeter becomes g2 and the value of blue color measured by the colorimeter becomes b2. In order to restore the original chrominance of white light, the restored color gain compensation value must be estimated according to the difference values including (r1-r2) of red color, (g1-g2) of green color and (b1-b2) of blue color, and then color gain compensation value will be estimated according to real-time ambient light information and the restored color gain compensation value. The restored color gain compensation value mainly compensates for the color deviation of the backlight module due to component aging.

In addition, the step S4 can store a plurality of preset color temperature sections and determine whether the real-time ambient light information belongs to any color temperature section of the plurality of color temperature sections and determine the color gain compensation value according to the color temperature section and the restored color gain compensation value. For example, if the real-time ambient light information belongs to the first color temperature section of the plurality of color temperature sections, then the step S4 can determine the color gain compensation value according to the first color temperature section and the restored color gain compensation value, but not limited thereto.

Figure 4A:
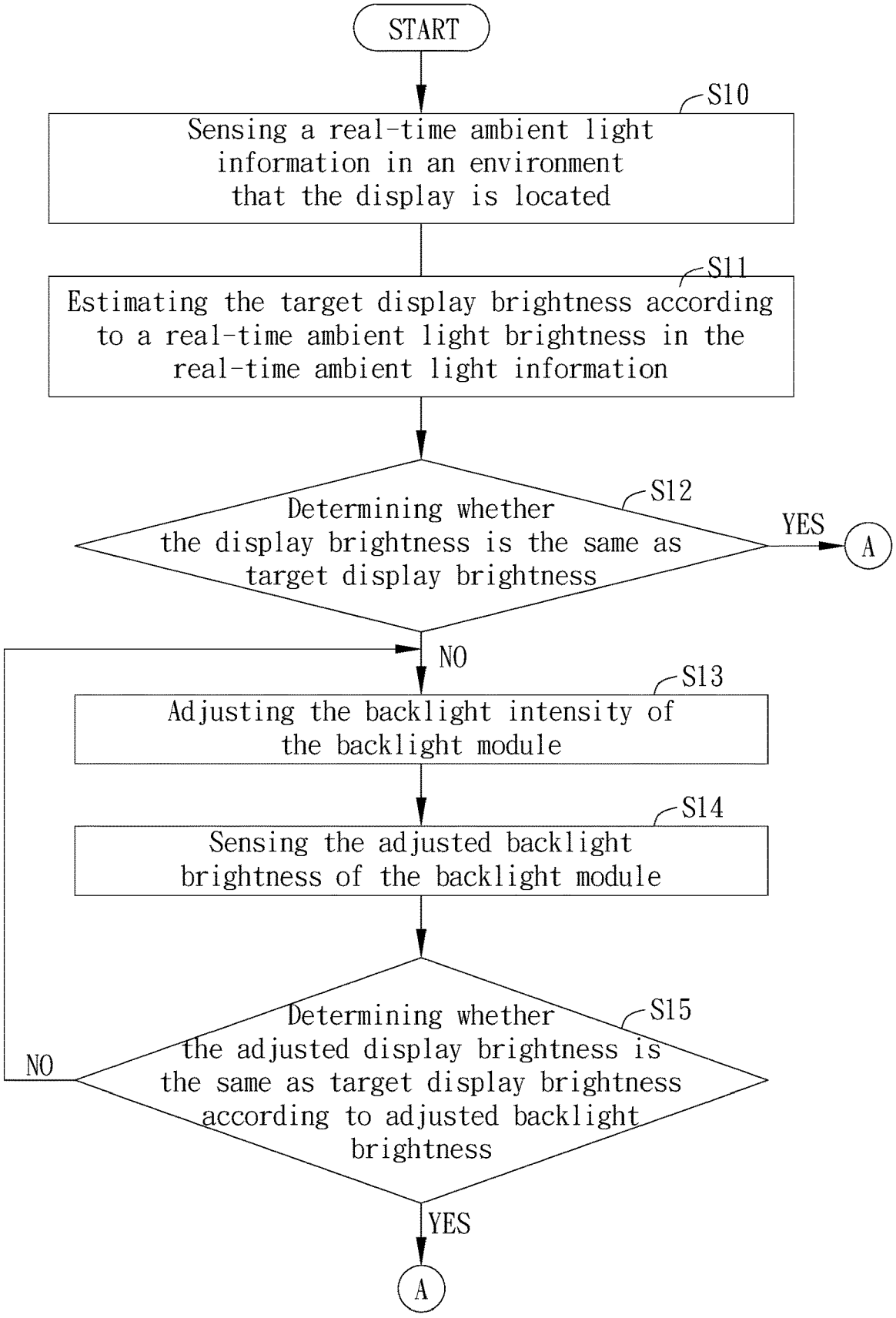
FIG. 4A and FIG. 4B illustrate a flowchart of the color correction method in another embodiment of the invention.
Figure 4B:
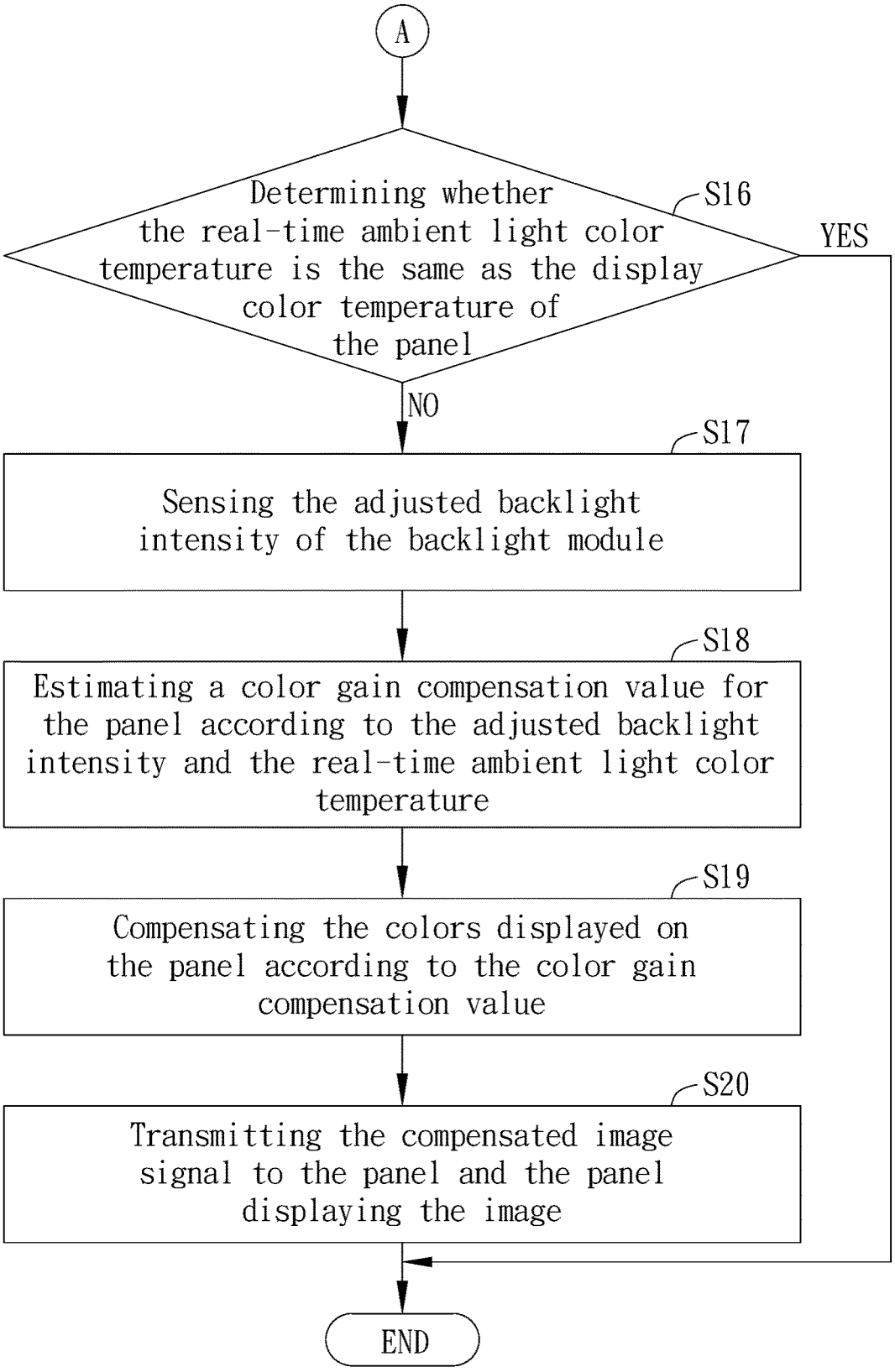

As shown in FIG. 4A and FIG. 4B, in another embodiment, the color correction method can include the following steps:

S10: sensing a real-time ambient light information in an environment that the display is located;

S11: estimating the target display brightness according to a real-time ambient light brightness in the real-time ambient light information;

S12: determining whether the display brightness of the panel is the same as the target display brightness;

S13: adjusting the backlight intensity of the backlight module when the determination result of the step S12 is no;

S14: sensing the adjusted backlight brightness of the backlight module;

S15: determining whether the adjusted display brightness of the panel is the same as the target display brightness according to the adjusted backlight brightness, when the determination result of the step S15 is no, then re-performing the step S13;

S16: when the determination result of the step S12 or the step S15 is yes, determining whether the real-time ambient light color temperature of the real-time ambient light information is the same as the display color temperature of the panel;

S17: when the determination result of the step S16 is no, sensing the adjusted backlight intensity of the backlight module;

S18: estimating a color gain compensation value for the panel according to the adjusted backlight intensity and the real-time ambient light color temperature of the real-time ambient light information;

S19: compensating the colors displayed on the panel according to the color gain compensation value; and S20: transmitting the compensated image signal to the panel and the panel displaying the image.

Next, how the panel brightness characteristic information is generated by the present invention will be described.

Figure 5:
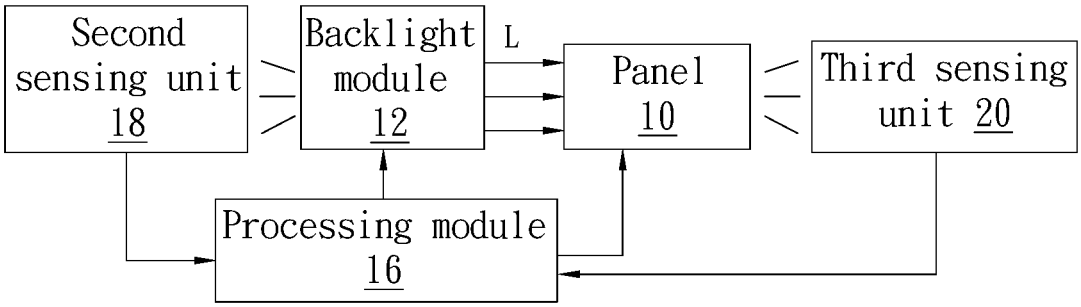
FIG. 5 illustrates a schematic diagram of the display further including a third sensing unit performing sensing on the panel.
Figure 6:
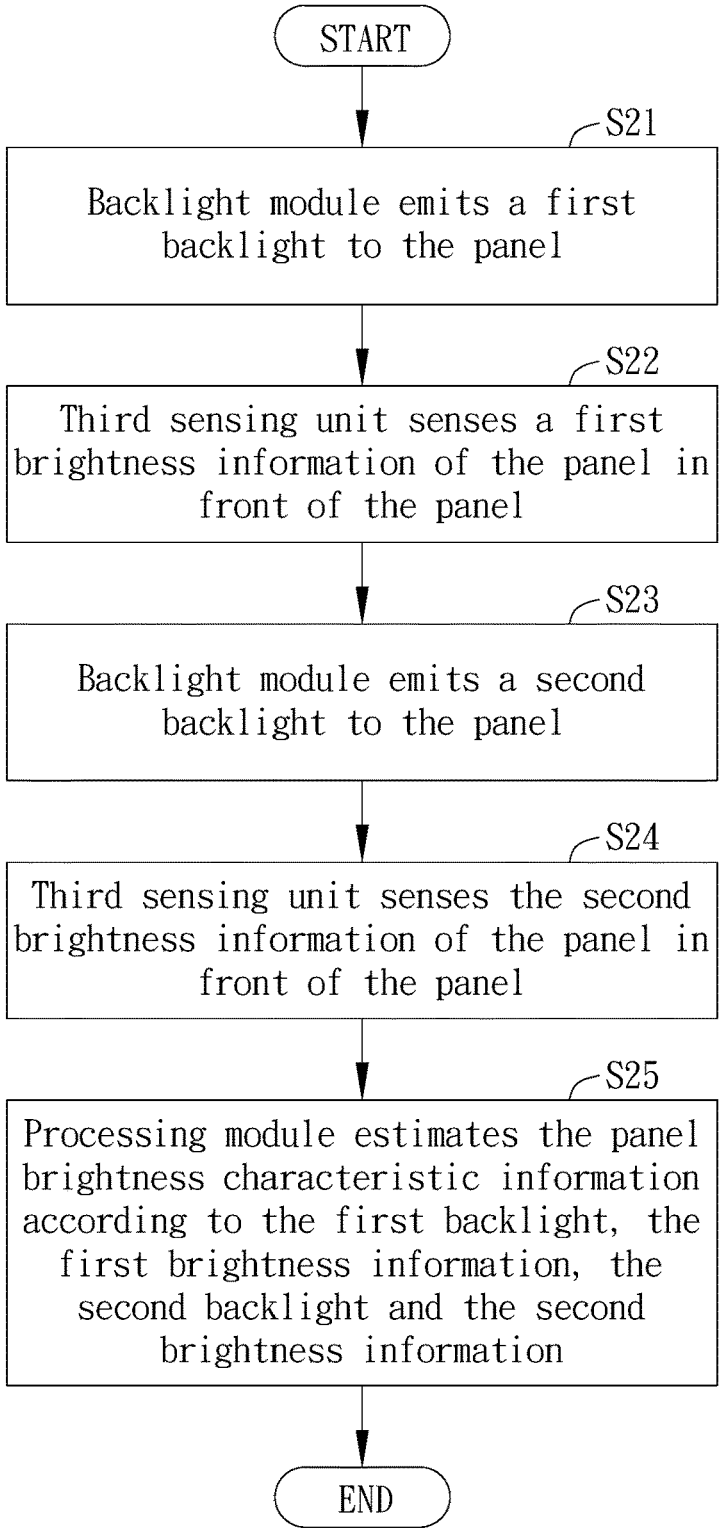
FIG. 6 illustrates a flowchart of generating the panel brightness characteristic information in an embodiment.

Please refer to FIG. 5 and FIG. 6 at the same time. FIG. 5 illustrates a schematic diagram of the display further including a third sensing unit performing sensing on the panel. FIG. 6 illustrates a flowchart of generating the panel brightness characteristic information in an embodiment.

As shown in FIG. 5, the processing module 16 is coupled to the panel 10, the backlight module 12, the second sensing unit 18 and the third sensing unit 20. The backlight module 12 emits a backlight L to the panel 10. The second sensing unit 18 and the third sensing unit 20 are disposed on a side of the backlight module 12 and the panel 10 respectively and used for sensing the backlight module 12 and the panel 10 respectively.

When the display 1 is in a factory before sale, in a calibration process, the backlight module 12 can sequentially emit a plurality of backlights having different powers to the panel 10 to estimate the panel brightness characteristic information. For example, it is assumed that the backlight module 12 sequentially emits two backlights having different powers to the panel 10. When the backlight module 12 emits a first backlight to the panel 10 (the step S21 in FIG. 6), the third sensing unit 20 can sense a first brightness information of the panel 10 in front of the panel 10 (the step S22 in FIG. 6) and transmit the first brightness information to the processing module 16; when the backlight module 12 emits a second backlight to the panel 10 (the step S23 in FIG. 6), the third sensing unit 20 can sense the second brightness information of the panel 10 in front of the panel 10 (the step S24 in FIG. 6) and transmit the first brightness information to the processing module 16. Then, the processing module 16 can estimate the panel brightness characteristic information according to the first backlight, the first brightness information, the second backlight and the second brightness information (the step S25 in FIG. 6) and store the panel brightness characteristic information in the storage unit 19.

When the processing module 16 receives the first section backlight intensity of the first backlight emitted by the backlight module 12, the first brightness information of the panel 10, the second section backlight intensity of the second backlight emitted by the backlight module 12 and the second brightness information of the panel 10, the processing module 16 can use an algorithm (e.g., the interpolation method, but not limited thereto) to obtain the panel brightness characteristic information (e.g., a panel brightness characteristic matrix, but not limited thereto) according to the first section backlight intensity, the first brightness information, the second section backlight intensity and the second brightness information.

It should be noted that the panel brightness characteristic information obtained by the processing module 16 can include a correspondence relationship between the display brightness of the panel 10 and the backlight intensity of the backlight module 12, such as a non-linear correspondence, but not limited thereto, and the interpolation method can be used to obtain the relative relationship of the unmeasured points between different measurement sampling points. Therefore, under the condition that the panel brightness characteristic information is unchanged, the processing module 16 can correspondingly estimate the backlight intensity that the backlight emitted by the backlight module 12 should have according to the display brightness of the panel 10 and the panel brightness characteristic information, or correspondingly estimate the display brightness in front of the panel 10 that the panel 10 should have according to the backlight intensity of the backlight module 12 and the panel brightness characteristic information.

For example, it is assumed that the display brightness of the panel 10 sensed by the third sensing unit 20 is X, the backlight intensity of the backlight module 12 sensed by the second sensing unit 18 is Y and the panel brightness characteristic information is Z. If the display brightness X of the panel 10 is equal to the product of the backlight intensity Y of the backlight module 12 and the panel brightness characteristic information Z, that is, $X=Y*Z$. When the backlight intensity of the backlight module 12 sensed by the second sensing unit 18 is changed from Y to Y', the display brightness of the panel 10 will be also changed from X to X', and the changed display brightness X' of the panel 10 will be equal to the product of the changed backlight intensity Y' of the backlight module 12 and the panel brightness characteristic information Z, that is, $X'=Y'*Z$. The rest can be deduced by analogy and will not be described here.

In addition, after the display 1 is used for a long period of time, the panel brightness characteristic information originally used may be changed. Therefore, an external color correction device can be cooperated with the second sensing unit 18 and the third sensing unit 20 in the display 1 to re-perform the steps S21~S25 in FIG. 6, and then the processing module 16 re-estimates new panel brightness characteristic information and updates and replaces the panel brightness characteristic information originally stored by the storage unit 19 with the new panel brightness characteristic information.

Figure 7:
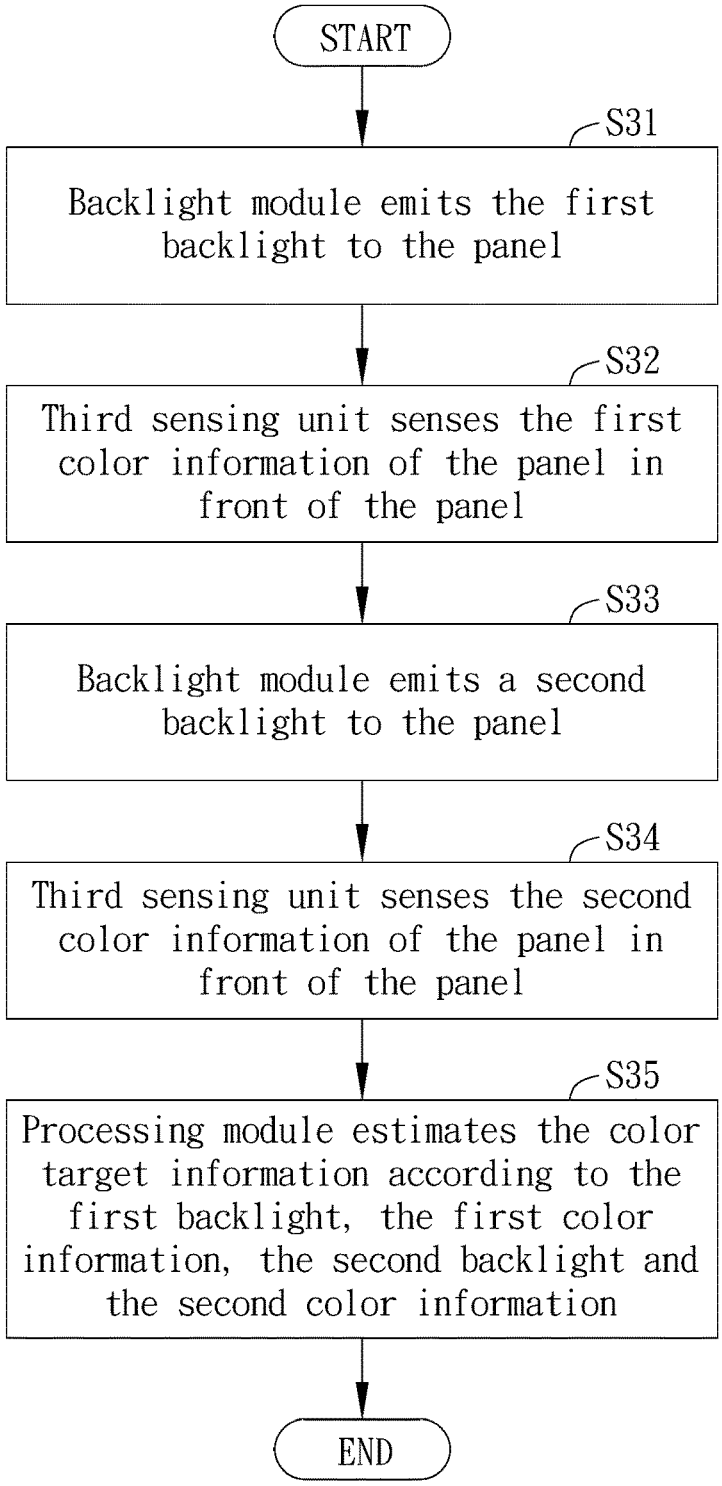
FIG. 7 illustrates a flowchart of generating the color target information in an embodiment.

Similarly, please refer to FIG. 5 and FIG. 7 simultaneously. FIG. 7 illustrates a flowchart of generating the target color information in an embodiment. When the display 1 is in a factory before sale, in a calibration process, the backlight module 12 can sequentially emit a plurality of backlights having different powers to the panel 10. For example, it is assumed that the backlight module 12 sequentially emits two backlights having different powers to the panel 10. When the backlight module 12 emits the first backlight to the panel 10 (the step S31 in FIG. 7), the third sensing unit 20 can sense the first color information of the panel 10 in front of the panel 10 (the step S32 in FIG. 7) and transmit the first color information to the processing module 16; when the backlight module 12 emits a second backlight to the panel 10 (the step S33 in FIG. 7), the third sensing unit 20 can sense the second color information of the panel 10 in front of the panel 10 (the step S34 in FIG. 7) and transmit the second color information to the processing module 16. Then, the processing module 16 can estimate the target color information according to the first backlight, the first color information, the second backlight and the second color information (the step S35 in FIG. 7) and then store the target color information in the storage unit 19.

Since the target color information obtained by the processing module 16 includes the correspondence relationships between the real-time color information of the panel 10 and the different backlight intensities emitted by the backlight module 12, so that the processing module 16 can correspondingly estimate the backlight intensity that the backlight module 12 should have according to the real-time color information and the target color information of the panel 10, or correspondingly estimate the real-time color information that the backlight module 12 should have according to the backlight intensity of the backlight module 12 and the target color information.

It should be noted that the third sensing unit 20 used for sensing the panel 10 can be a colorimeter. When the backlight module 12 emits different backlight intensities to the panel 10 respectively, the colorimeter disposed in front of the panel 10 can measure the color information (e.g., the intensity value of the chrominance and the brightness) of pure white, pure red, pure blue and pure green on the panel 10 respectively and compensate the lights emitted by the panel 10 to emit pure white light in front of the panel 10, thereby the effect of compensating for the color attenuation of the backlight module 12 can be achieved. In fact, according to the principle of three primary colors of light, if the color information of the pure red, the pure blue and the pure green displayed on the panel 10 respectively measured by the colorimeter is added, the color information of the pure white displayed on the panel 10 can be also obtained.

In addition, when the display device 1 is used for a long period of time, the target color information originally used may lose accuracy due to the change of the panel characteristics. Therefore, an external color correction device can be cooperated with the second sensing unit 18 in the display 1 to re-perform the steps S31~S35 in FIG. 7, and the processing module 16 re-estimates the new target color information and updates and replaces the target color information originally stored in the storage unit 19 with the new target color information.

Compared to the prior arts, the display and the color correction method of the present invention firstly sense the chrominance and brightness change information of the ambient light through the ambient light sensor to estimate the target display brightness that the panel should have, and then adjust the backlight intensity of the backlight module to make the brightness of the panel is substantially the same as the target display brightness, and then sense the adjusted backlight intensity through the backlight sensor to estimate the color gain compensation value for the panel and compensate the colors displayed on the panel when the panel displays an image according to the color gain compensation value.

By doing so, even if the backlight emitted by the backlight module changes and the brightness and chrominance of the panel deviate from the color performance consistent with the ambient light, the present invention can adjust the backlight intensity of the backlight module according to the real-time sensed ambient light information and then compensate the colors displayed on the panel according to the adjusted backlight intensity and the panel characteristic information, thereby the color attenuation of the backlight module can be effectively compensated, and the brightness and chrominance of the panel can maintain the color performance consistent with the ambient light, so that the human eye can have a more comfortable feeling when viewing the display.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A color correction method applied to a display, the display comprising a panel and a backlight module, the color correction method comprising steps of:

(a) sensing a real-time ambient light information of an environment that the display is located in;

(b) estimating a target display brightness according to the real-time ambient light information;

(c) adjusting a backlight intensity of the backlight module to an adjusted backlight intensity to make a display brightness of the panel substantially the same as the target display brightness;

(d) sensing an adjusted backlight information of the backlight module and estimating a color gain compensation value for the panel according to the adjusted backlight information and the real-time ambient light information; and (e) compensating the colors displayed on the panel when the panel displays an image according to the color gain compensation value.

2. The color correction method of claim 1, wherein the step (c) further comprises:

adjusting the backlight intensity of the backlight module according to a panel brightness characteristic information and the target display brightness.

3. The color correction method of claim 2, wherein the panel brightness characteristic information is generated by steps of:

(f1) sensing a first brightness information of the panel in front of the panel when the backlight module emits a first backlight to the panel;

(f2) sensing a second brightness information of the panel in front of the panel when the backlight module emits a second backlight to the panel, wherein the second backlight is different from the first backlight; and (f3) estimating the panel brightness characteristic information according to the first backlight, the first brightness information, the second backlight and the second brightness information.

4. The color correction method of claim 3, wherein the step (f3) further comprises:

estimating the panel brightness characteristic information according to an interpolation method.

5. The color correction method of claim 1, wherein the step (d) further comprises:

(d1) estimating a restored color gain compensation value according to the adjusted backlight information and a target color information; and (d2) estimating the color gain compensation value according to the real-time ambient light information and the restored color gain compensation value.

6. The color correction method of claim 5, wherein the target color information is a plurality of target color values of the backlight module corresponding to different backlights, and the restored color gain compensation value is estimated according to a difference between the adjusted backlight information and the target color information.

7. The color correction method of claim 5, wherein the step (d1) further comprises:

sensing a first color information of the panel in front of the panel when the backlight module emits a first backlight to the panel;

sensing a second color information of the panel in front of the panel when the backlight module emits a second backlight to the panel, wherein the second backlight is different from the first backlight; and estimating the target color information according to the first backlight, the first color information, the second backlight and the second color information.

8. The color correction method of claim 5, wherein the step (d2) further comprises:

setting a plurality of color temperature sections;

determining that the real-time ambient light information belongs to a first color temperature section of the plurality of color temperature sections; and determining the color gain compensation value according to the first color temperature section and the restored color gain compensation value.

9. The color correction method of claim 1, wherein the real-time ambient light information comprises a real-time ambient light brightness, a real-time ambient light chrominance and a real-time ambient light color temperature.

10. A display, comprising:

a panel;

a backlight module, configured to emit a backlight to the panel;

a first sensing unit, configured to sense a real-time ambient light information of an environment that the display is located in;

a second sensing unit, disposed at a side of the backlight module; and a processing module, coupled to the panel, the backlight module, the first sensing unit and the second sensing unit respectively, the processing module estimating a target display brightness according to the real-time ambient light information and adjusting a backlight intensity of the backlight module to an adjusted backlight intensity to make a display brightness of the panel substantially the same as the target display brightness, and the second sensing unit sensing an adjusted backlight information of the backlight module, and the processing module estimating a color gain compensation value for the panel according to the adjusted backlight information and the real-time ambient light information and compensating the colors displayed on the panel when the panel displays an image according to the color gain compensation value.

11. The display of claim 10, wherein the processing module adjusts the backlight intensity of the backlight module according to a panel brightness characteristic information and the target display brightness.

12. The display of claim 11, further comprising:

a third sensing unit;

wherein when the backlight module emits a first backlight to the panel, the third sensing unit senses a first brightness information emitted by the panel; when the backlight module emits a second backlight to the panel, the third sensing unit senses a second brightness information emitted by the panel, and the processing module estimates the panel brightness characteristic information according to the first backlight, the first brightness information, the second backlight and the second brightness information, wherein the second backlight is different from the first backlight.

13. The display of claim 12, wherein the processing module estimates the panel brightness characteristic information according to interpolation method.

14. The display of claim 11, further comprising:

a third sensing unit;

wherein when the backlight module emits a first backlight to the panel, the third sensing unit senses a first color information of the panel; when the backlight module emits a second backlight to the panel, the third sensing unit senses a second color information of the panel, and the processing module estimates the target color information according to the first backlight, the first color information, the second backlight and the second color information, wherein the second backlight is different from the first backlight.

15. The display of claim 10, wherein the processing module estimates a restored color gain compensation value according to the adjusted backlight information and a target color information and estimates the color gain compensation value according to the real-time ambient light information and the restored color gain compensation value.

16. The display of claim 15, wherein the target color information is a plurality of target color values of the backlight module corresponding to different backlights, and the restored color gain compensation value is estimated according to a difference between the adjusted backlight information and the target color information.

17. The display of claim 15, wherein the processing module stores a plurality of color temperature sections, when the processing module determines that the real-time ambient light information belongs to a first color temperature section of the plurality of color temperature sections, the processing module determines the color gain compensation value according to the first color temperature section and the restored color gain compensation value.

18. The display of claim 10, wherein the real-time ambient light information comprises a real-time ambient light brightness, a real-time ambient light chrominance and a real-time ambient light color temperature.

19. A color correction method applied to a display, the display comprising a panel and a backlight module, the color correction method comprising steps of:

(a) sensing a real-time ambient light information of an environment that the display is located in;

(b) estimating a target display brightness according to the real-time ambient light information;

(c) adjusting a backlight intensity of the backlight module to an adjusted backlight intensity to make a display brightness of the panel substantially the same as the target display brightness;

(d) sensing an adjusted backlight information of the backlight module and estimating a color gain compensation value for the panel according to the adjusted backlight information and a target color information; and (e) compensating the colors displayed on the panel when the panel displays an image according to the color gain compensation value.

20. The color correction method of claim 19, further comprising:

making the backlight module to emit different backlight values to the panel and correspondingly measure a plurality of color information in front of the panel when the display is in a factory before sale; and estimating the target color information according to the different backlight values and the plurality of color information.

* * * * *